US008752728B2

(12) United States Patent
Tignanelli et al.

(10) Patent No.: US 8,752,728 B2
(45) Date of Patent: Jun. 17, 2014

(54) PORTABLE, TIME-RELEASE DOSAGE FORM DISPENSING ASSEMBLY

(75) Inventors: Jason S. Tignanelli, Oakland Township, MI (US); Matthew K. Winget, Oakland Township, MI (US)

(73) Assignee: Orbital Innovations, LLC, Oakland Township, MI (US)

( * ) Notice: Subject to any disclaimer, the term of this patent is extended or adjusted under 35 U.S.C. 154(b) by 269 days.

(21) Appl. No.: 13/430,144

(22) Filed: Mar. 26, 2012

(65) Prior Publication Data

US 2013/0248551 A1 Sep. 26, 2013

(51) Int. Cl.

| | |
|---|---|
| ***B65B 59/00*** | (2006.01) |
| ***B65H 31/20*** | (2006.01) |
| ***A61J 1/03*** | (2006.01) |
| ***A61J 7/04*** | (2006.01) |
| ***B65D 83/04*** | (2006.01) |

(52) U.S. Cl.
CPC *A61J 1/03* (2013.01); *A61J 7/0481* (2013.01); *B65D 83/0409* (2013.01)
USPC ..... 221/15; 221/241

(58) Field of Classification Search
CPC ..... A61J 1/03; A61J 7/0481; A61J 7/0472; A61J 7/0409; B65D 83/04; B65D 83/0409; B65D 83/0454; G07F 11/44; G07F 17/0092
USPC ..... 221/15, 241
See application file for complete search history.

(56) References Cited

U.S. PATENT DOCUMENTS

| | | | | |
|---|---|---|---|---|
| 3,224,634 | A * | 12/1965 | Semsch | 221/299 |
| 4,523,694 | A * | 6/1985 | Veltri | 221/265 |
| 5,259,532 | A * | 11/1993 | Schwarzli | 221/304 |
| 5,412,372 | A | 5/1995 | Parkhurst et al. | |
| 5,582,323 | A | 12/1996 | Kurtenbach | |
| 6,131,765 | A * | 10/2000 | Barry et al. | 221/264 |
| 6,155,454 | A | 12/2000 | George et al. | |
| 6,194,995 | B1 | 2/2001 | Gates | |
| 6,259,654 | B1 | 7/2001 | de la Huerga | |
| 6,581,797 | B2 | 6/2003 | McKinney, Jr. et al. | |
| 7,128,240 | B1 | 10/2006 | Oesch | |
| 7,147,130 | B1 | 12/2006 | Clark et al. | |
| 7,213,721 | B2 * | 5/2007 | Abdulhay et al. | 221/3 |

(Continued)

OTHER PUBLICATIONS

E-pill Pill Bottle Multi Alarm; Web page: http://www.epill.com/bottle.html.

GlowCaps; Web page: http://www.vitality.net/glowcaps_howglowcapswork.html.

AT&T—enables Smart Pill Bottles; web page: http://www.ajc.com/business/at-t-enables-smart-794897.html.

Automatic Medication Dispensers; web page: http://www.dynamic-living.com/printPage/product/automatic-medication-dispensers/.

*Primary Examiner* — Timothy Waggoner
(74) *Attorney, Agent, or Firm* — Brooks Kushman P.C.

(57) ABSTRACT

A portable, time-release, dosage form dispensing assembly is provided. A hopper holds a supply of like, loose and randomly oriented dosage forms. The hopper including a bottom portion having an opening sized and shaped for receiving one of the dosage forms. An electromechanical apparatus dispenses the dosage forms from the hopper through the opening. The apparatus is adapted to dispense the dosage forms to a dispensing area one dosage form at a time. A programmable controller generates a set of control signals to control the apparatus to dispense a preselected number of dosage forms at a preselected time of day or time interval. A communication apparatus wirelessly communicates a first set of data to the controller to program the controller. The first set of data represents the preselected number and the preselected time of day or time interval.

19 Claims, 4 Drawing Sheets

(56) References Cited

U.S. PATENT DOCUMENTS

| | | | | |
|---|---|---|---|---|
| 7,359,765 | B2 * | 4/2008 | Varvarelis et al. | 700/237 |
| 7,513,391 | B2 * | 4/2009 | Nakanishi | 221/241 |
| 7,545,257 | B2 | 6/2009 | Brue | |
| 7,735,683 | B2 * | 6/2010 | Handfield et al. | 221/241 |
| 7,877,268 | B2 | 1/2011 | Kulkarni | |
| 7,896,192 | B2 * | 3/2011 | Conley et al. | 221/15 |
| 8,423,181 | B2 * | 4/2013 | Hallin | 700/237 |
| 2009/0315702 | A1 | 12/2009 | Cohen Alloro | |
| 2010/0123429 | A1 * | 5/2010 | Chen et al. | 320/108 |
| 2011/0306852 | A1 | 12/2011 | Hafezi | |

* cited by examiner

PORTABLE, TIME-RELEASE DOSAGE FORM DISPENSING ASSEMBLY

TECHNICAL FIELD

This invention relates in general to the field of portable, automatic, dosage form dispensing and, in particular, to portable, time-release dosage form dispensing assemblies.

Overview

Solid oral dosage form drug products for human use include prescription drug products, over-the-counter drug products, biological drug products, and homeopathic drug products.

A "drug product" has been defined to mean a finished dosage form, e.g., a tablet or capsule that contains a drug substance, generally, but not necessarily, in association with one or more other ingredients.

A "solid oral dosage form" has been defined to mean capsules, tablets, or similar drug products intended for oral use.

Drug products in solid oral dosage form often times have distinct size, shape (i.e., round or oval) and color, which help to uniquely identify the drug product and the manufacturer or distributor of the product.

Oftentimes there are few, if any, controls limiting the amount of medication a user can remove from the mechanism bottle per each opening of the bottle. This results in intentional or accidental overdose, drug misuse and the illegal "selling" of prescription medications.

U.S. Pat. No. 7,213,721 discloses a personal medication dispenser which has one or more chambers for holding a supply of pills. A feed mechanism is associated with each chamber and is selectively operative to dispense an incremental number of pills from each respective chamber. A programmable controller is coupled to control and operate the feed mechanism. The controller has a timer, a memory and an input means and is programmably operable by the user and/or by remote input from a smart card, PDA or various networks such as one having access to data from a pharmacy. The programming presets at least one of a time and a number of pills to be dispenses from each chamber. The controller operates an alarm to alert the user and operates the feed mechanism to dispense pills at the preset time and number, also detecting the user's access to obtain the dispensed pills.

U.S. Pat. No. 7,359,765 discloses an electronic pill dispenser including a container and a cap removably attached to the container. Components of the pill dispenser include a power source, pill dispenser circuitry, a real time clock, a counter, a display, a dispensing mechanism, a sensor, a visual indicator, an audible indicator, an input/output interface, an input output port, and a communication bus electrically interconnecting the components. The pill dispenser may also include a physical indicator, a locking mechanism, a transceiver, an antenna, and a modem.

U.S. Pat. No. 5,582,323 discloses a medication dispenser and monitor including a housing containing a plurality of pill dispensing compartments for dispensing medication to a patient at a desired time. The invention is programmed to dispense medication at the desired time and activates alarms if the proper procedure is not completed. The invention also contacts emergency personnel through phone lines and initiates two-way hands free communication between the patient and the emergency personnel.

Other related U.S. patents include U.S. Pat. Nos. 6,194,995; 6,259,654 and 6,581,797.

There are problems associated with the prior art including complexity, cost and the power needs of the electrical and electronic equipment of the medication dispensers.

SUMMARY OF THE EXAMPLE EMBODIMENTS

One object of at least one embodiment of the present invention is to provide a portable, time-release dosage form dispensing assembly that contains relatively simple and inexpensive yet utilitarian electrical, electronic, electromechanical and mechanical components.

In carrying out the above object and other objects of the present invention a portable, time-release, dosage form dispensing assembly is provided. The assembly includes a hopper for holding a supply of like, loose and randomly oriented dosage forms. The hopper includes a bottom portion having an opening sized and shaped for receiving one of the dosage forms. The assembly also includes an electromechanical apparatus that dispenses the dosage forms from the hopper through the opening. The apparatus is adapted to dispense the dosage forms to a dispensing area one dosage form at a time. The assembly further includes a programmable controller for generating a set of control signals to control the apparatus to dispense a preselected number of dosage forms at a preselected time of day or time interval. The assembly still further includes a communication apparatus for wirelessly communicating a first set of data to the controller to program the controller. The first set of data represents the preselected number and the preselected time of day or time interval.

The communication apparatus may be a two-way communication apparatus for wirelessly communicating the first set of data to the controller and a second set of data from the controller. The second set of data may represent the number of dispensed dosage forms.

The assembly may further include an electromechanical vibrator to vibrate the hopper so that dosage forms are advanced towards the opening.

The assembly may further include a rechargeable battery and circuitry coupled to the battery to wirelessly receive an electrical power signal to recharge the battery. The battery may provide electrical energy to the controller, the electromechanical apparatus and the communication apparatus. The battery may also provide electrical energy to the vibrator.

The communication apparatus may include a transceiver such as an RF transceiver.

The circuitry may include an electrical coil to inductively receive the electrical power signal. The coil may also receive the first set of data.

The communication apparatus may include an IR transmitter to wirelessly communicate a second set of data from the controller, wherein the second set of data represents the number of dispensed dosage forms.

The programmable controller may include a microprocessor.

The assembly may include a housing having top and bottom parts and a locking mechanism to prevent removal of the top part from the bottom part and prevent access to the hopper by a user of the assembly.

The assembly may include a door having open and closed positions. The door is movably connected to the bottom part to permit access to the dispensed dosage forms in the open position.

The electromechanical apparatus may include an electric motor having a rotary output shaft, gearing in driving engagement with the shaft, and a wheel in driving engagement with the gearing and supported for rotary movement immediately adjacent the opening. The wheel may have an aperture extending completely therethrough wherein a single dosage form is dispensed to the dispensing area when the aperture and the opening are substantially aligned.

The size of the aperture may be adjustable to receive dosage forms having different sizes.

Further in carrying out the above object and other objects of the present invention, a portable, time-release, dosage form dispensing assembly is provided. The assembly includes a hopper for holding a supply of like, loose and randomly oriented dosage forms. The hopper includes a bottom portion having an opening sized and shaped for receiving one of the dosage forms. The assembly also includes an electromechanical apparatus that dispenses the dosage forms from the hopper through the opening. The apparatus is adapted to dispense the dosage forms to a dispensing area one dosage form at a time. The assembly further includes an electromechanical vibrator to vibrate the hopper so that dosage forms are advanced towards the opening. The assembly still further includes a programmable controller for generating a set of control signals to control the apparatus to dispense a preselected number of dosage forms at a preselected time of day or time interval. The assembly also includes a two-way communication apparatus for wirelessly communicating a first set of data to the controller to program the controller. The first set of data represents the preselected number and the preselected time of day or time interval. The communication apparatus also wirelessly communicates a second set of data from the controller. The second set of data represents the number of dispensed dosage forms. The assembly further includes a rechargeable battery and circuitry coupled to the battery to wirelessly receive an electrical power signal to recharge the battery. The battery provides electrical energy to the controller, the electromechanical apparatus, the communication apparatus and the vibrator.

The circuitry may include an electrical coil to inductively receive the electrical power signal.

Still further in carrying out the above object and other objects of the present invention, a portable, time-release, dosage form dispensing assembly is provided. The assembly includes a hopper for holding a supply of like, loose and randomly oriented dosage forms. The hopper includes a bottom portion having an opening sized and shaped for receiving one of the dosage forms. The assembly also includes an electromechanical apparatus that dispenses the dosage forms from the hopper through the opening. The apparatus is adapted to dispense the dosage forms to a dispensing area one dosage form at a time. The electromechanical apparatus includes an electric motor having a rotary output shaft, gearing in driving engagement with the shaft, and a wheel in driving engagement with the gearing and supported for rotary movement immediately adjacent the opening. The wheel has an aperture extending completely therethrough wherein a single dosage form is dispensed to the dispensing area when the aperture and the opening are substantially aligned. The assembly further includes a programmable controller for generating a set of control signals to control the apparatus to dispense a preselected number of dosage forms at a preselected time of day or time interval. The assembly includes a communication apparatus for wirelessly communicating a first set of data to the controller to program the controller. The first set of data represents the preselected number and the preselected time of day or time interval.

The assembly may include a housing including top and bottom parts and a locking mechanism to prevent removal of the top part from the bottom part and prevent access to the hopper by a user of the assembly.

The assembly may include a door having open and closed positions. The door is movably connected to the bottom part to permit access to the dispensed dosage forms in the open position.

DETAILED DESCRIPTION OF THE EXAMPLE EMBODIMENTS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
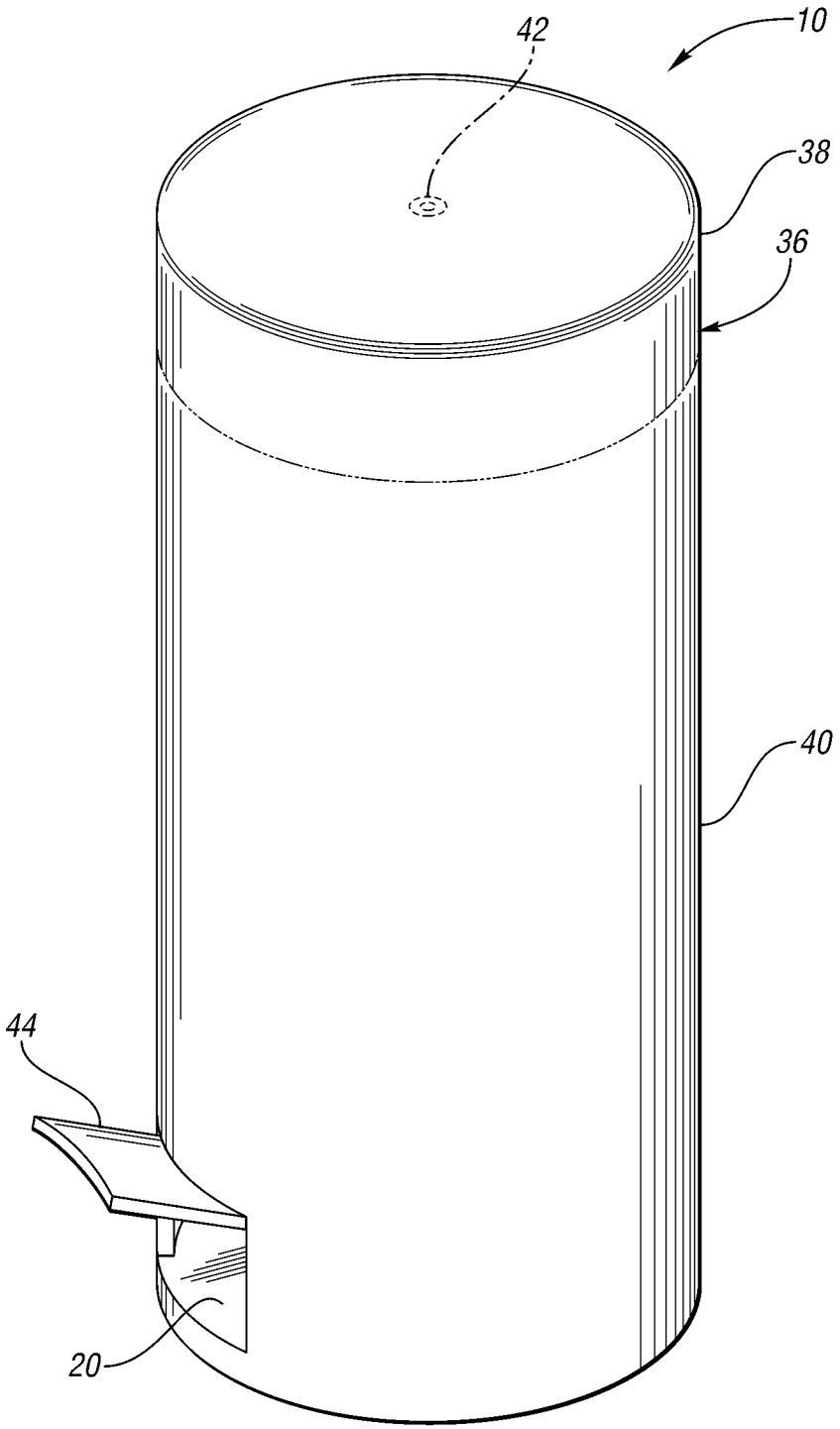
FIG. 1 is a perspective view of a portable, time-release dosage form dispensing assembly having its door in an open position and constructed in accordance with at least one embodiment of the present invention.
Figure 2:
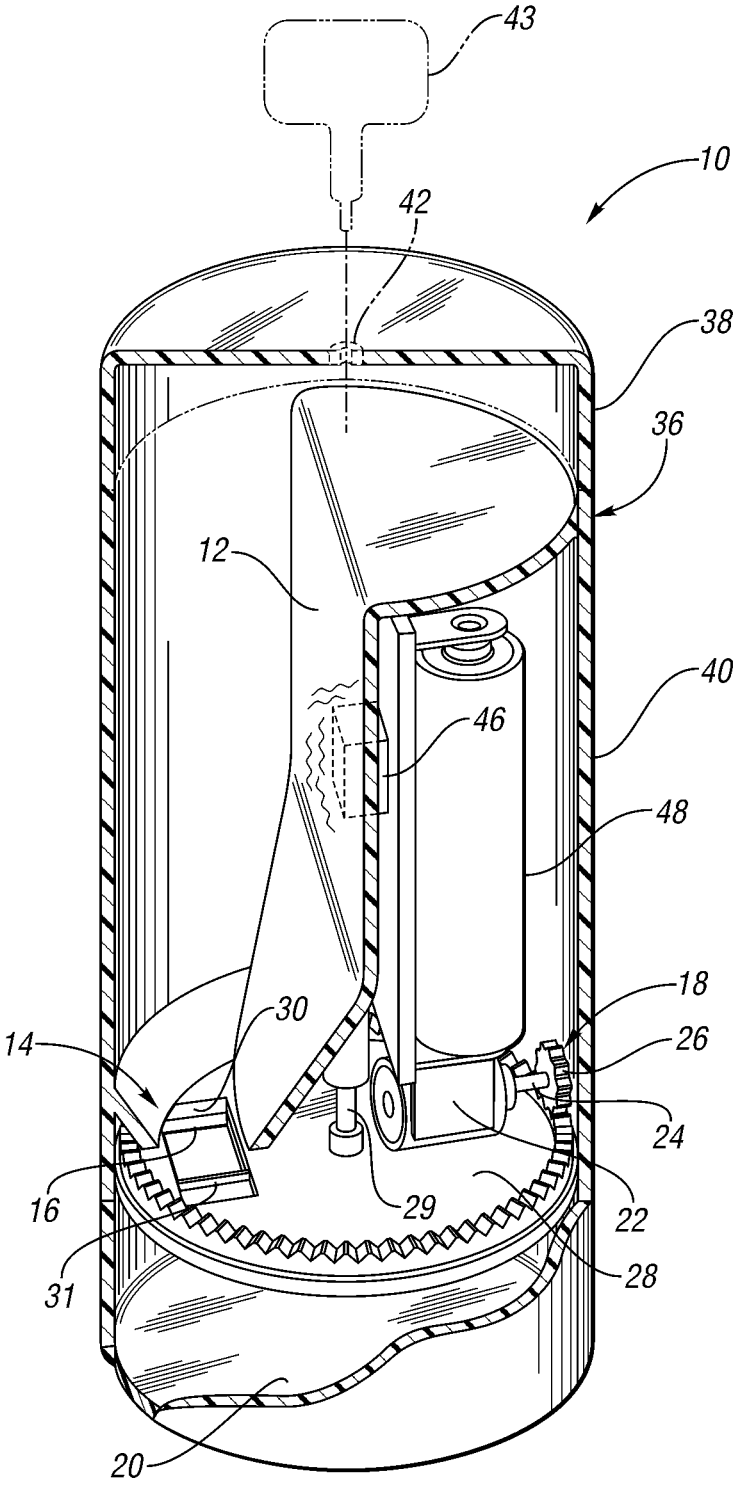
FIG. 2 is a sectional view of the assembly of FIG. 1 and illustrating the various electrical, electronic, electromechanical and mechanical parts of the assembly and also illustrating a key for use by someone authorized to gain access to a hopper in the assembly.
Figure 3:
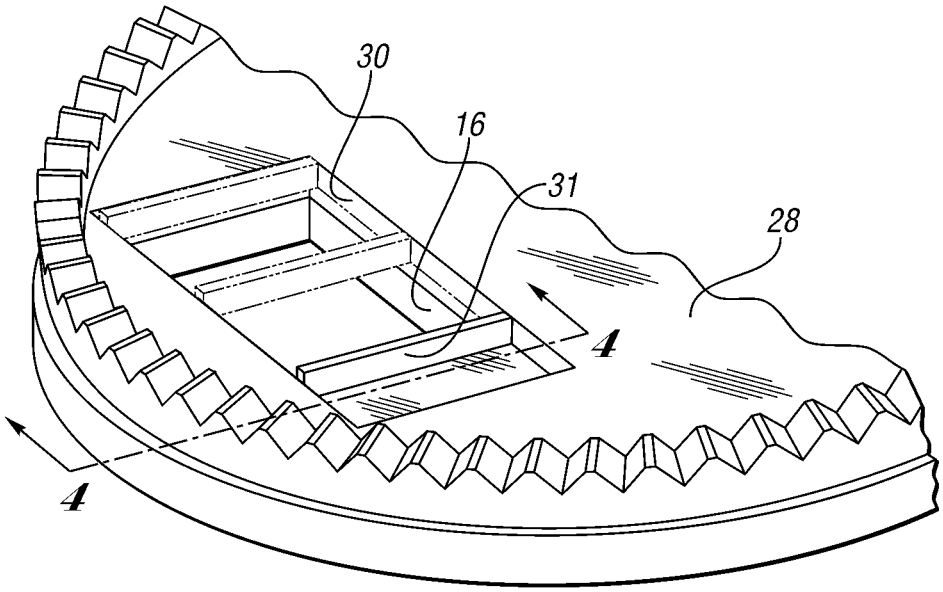
FIG. 3 is a perspective view, partially broken away, of an adjustable aperture provided by a door having different portions indicated by phantom lines in a wheel of the assembly.
Figure 4:
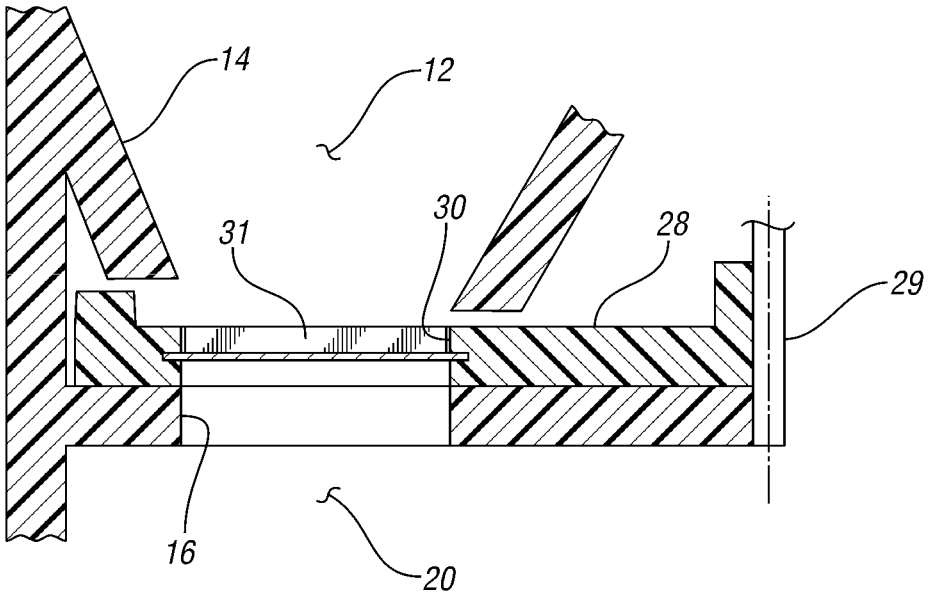
FIG. 4 is a sectional view taken along lines 4-4 in FIG. 3 which illustrates the adjustable aperture and an aligned opening in the bottom of the hopper.

Referring now to drawing FIGS. 1 and 2, a portable, time-release, dosage form dispensing assembly constructed in accordance with at least one embodiment of the present invention is generally indicated at 10. The assembly 10 includes a hopper 12 for holding a supply of like, loose and randomly oriented dosage forms, such as tablets and capsules. The hopper 12 includes a bottom portion 14 having an opening 16 sized and shaped for receiving one of the dosage forms.

The assembly 10 also includes an electromechanical apparatus generally indicated at 18, that dispenses the dosage forms from the hopper 12 through the opening 16. The apparatus 18 is adapted to dispense the dosage forms to a dispensing area 20 one dosage form at a time. The electromechanical apparatus 18 includes an electric motor 22 having a rotary output shaft 24, gearing 26 in driving engagement with the shaft 24, and a toothed wheel 28 in driving engagement with the gearing 26 and supported for rotary movement about a shaft 29 immediately adjacent the opening 16. The wheel 28 has an adjustably sized aperture 30 extending completely therethrough wherein a single dosage form is dispensed to the dispensing area 20 when the aperture 30 and the opening 16 are substantially aligned. The size of the aperture 16 is preferably adjustable via a door 31 slidable in the wheel 28 to receive dosage forms having different sizes, much like adjustable apertures in coin-operated candy and nut dispensers.

The assembly 10 also includes a programmably controller 32 (FIG. 5) such as a microprocessor for generating a set of output motor control signals to control the apparatus 18 (an external load) to dispense a preselected number of dosage forms at a preselected time of day or time interval.

The assembly 10 may further includes a communication apparatus 34, for wirelessly communicating a first set of data via an antenna 35 to the controller 32 to program the controller 32. The first set of data represents the preselected number and the preselected time of day or time interval. The communication apparatus 34 is preferably a two-way communication apparatus such as an RF transceiver for wirelessly communicating the first set of data to the controller 32 and a second set of data from the controller 32. The second set of data represents the number of dispensed dosage forms.

The assembly 10 also includes a plastic housing, generally indicated at 36, which includes top and bottom parts 38 and 40, respectively, and a locking mechanism 42 to prevent removal of the top part 38 from the bottom part 40 and prevent access to the hopper 12 by a user of the assembly 10. The antenna 35 may be embedded in the plastic housing 36. The locking mechanism may be locked/unlocked by a key, indicated at 43 in FIG. 2 by phantom lines.

The assembly 10 also includes a door 44 having open and closed positions. The door 44 is movably connected to the bottom part 40 to permit access to the dispensed dosage forms in the area 20 in the open position of the door 44.

The assembly 10 also preferably includes an electromechanical vibrator 46 mounted on an inner surface of a wall of the hopper 12 to vibrate the hopper 12 so that dosage forms are advanced towards the opening 16. The vibrator 46 may be generally of the type used in cell phones and the like and may also signal a user of the assembly that a dosage form is located in the area 20.

Figure 5:
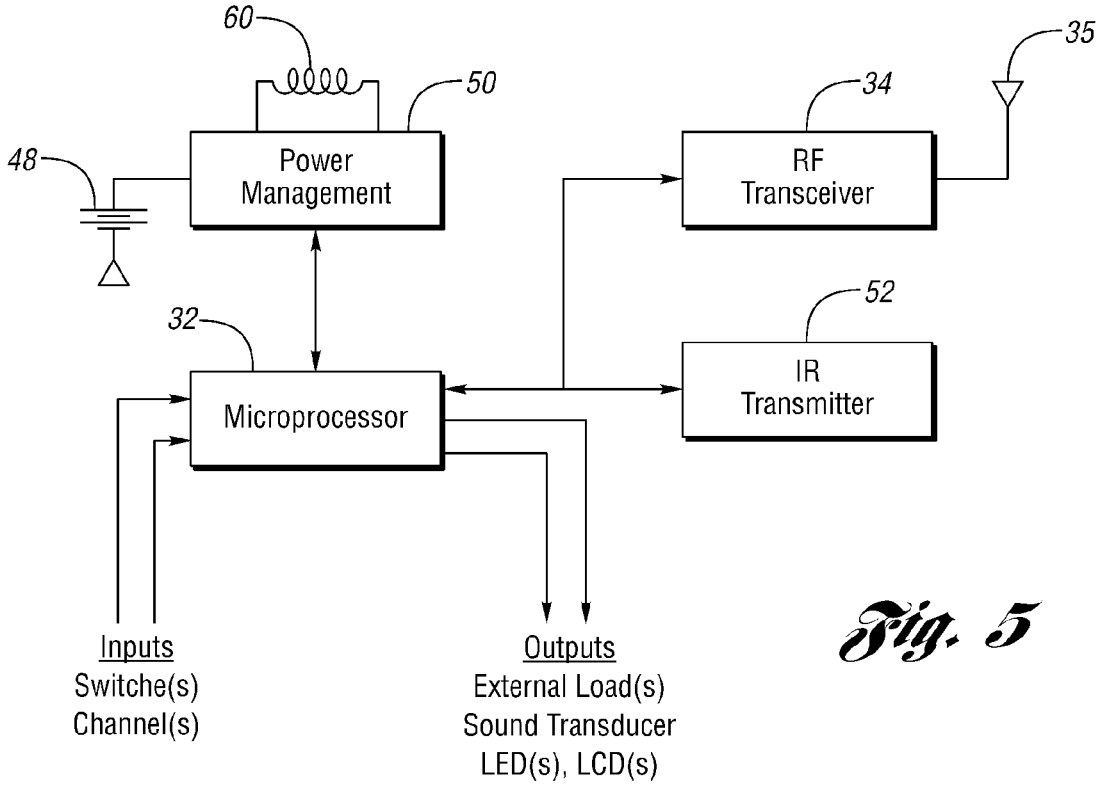
FIG. 5 is a schematic view of various electrical and electronic components of the assembly of FIG. 1.

The assembly 10 also preferably includes a rechargeable battery 48 and power management circuit or circuitry 50 coupled to the battery 48 to wirelessly (i.e., inductively) receive an electrical power signal to recharge the battery 48. The battery 48 provides electrical energy to the controller 32, the electromechanical apparatus 18, the communication apparatus 34 and the vibrator 46 (another external load as indicated in FIG. 5).

In one embodiment, the communication apparatus 34 includes a transceiver such as the RF (i.e., radio frequency) transceiver 34. The communication apparatus may also include an IR (i.e. infrared) transmitter 52 to wirelessly communicate a second set of data from the controller 32. The plastic housing 10 is preferably "transparent" to the RF and infrared signals. The second set of data represents the number of dispensed dosage forms which the microprocessor 32 keeps track of via an external sensor or switch (not shown) input to the microprocessor 32 (FIG. 5).

In another embodiment, the two-way communication apparatus includes circuitry including an electrical coil 60 to inductively receive the electrical power signal as described below. The electrical coil 60 may be embedded in the plastic housing 36 and may also receive the first set of data and transmit the second set of data as also described below thereby eliminating the need for the RF transceiver 34 and/or the IR transmitter 52.

Transfer of Electrical Power

Referring specifically to FIG. 5, there is shown a one-way electrical power and two-way data communication apparatus of one embodiment of this invention, which may be coupled to an energizing electronic coil (not shown but which may be located at a pharmacist) to provide power to the battery 48 of the assembly 10 when the assembly 10 is located adjacent or near the inductor or coil. Specifically, the circuitry 50 includes the inductor or coil 60 and the rest of the circuitry 50 includes a rectifier, and a data recovery and voltage regulator circuit coupled to the microprocessor 32. An electrical power signal is transferred to the inductor 60 by means of magnetic flux between the inductors including the inductor 60. Thereafter, the inductor 60 couples the received electrical power signal to the rectifier of the circuit 50. The rectifier rectifies the AC power signal to a DC power signal and transfers the DC electrical power to the rechargeable battery 48 under control of the microprocessor 32. Additionally, the rectified output of the rectifier is input into the voltage regulator which produces a regulated DC output voltage at a level which is required by the microprocessor 32. The battery 48 also supplies electrical power to the RF transceiver 34, the IR transceiver 52, the electromechanical vibrator 46 and the other electromechanical actuator (i.e., the electric motor 22).

In other words, upon receipt of the AC electrical power signal, the inductor 60 outputs this AC electrical signal to the rectifier of the circuit 50 which rectifies the received AC electrical power signal to obtain a DC signal which is controllably coupled to the battery 48 to recharge the battery 48.

Two-Way Data Communication

The electrical power signal received by the circuitry 50 may be modulated by control data from a main controller (not shown but also located at the pharmacist). A tuned circuit in the circuitry 50 has a resonant frequency. The resonant frequency provides an efficient transfer of electrical power to the battery 48 from the electrical power source. When it is desired to transmit control data from the main controller, the control data is transmitted to circuitry (not shown). This circuitry causes a signal to be produced in the inductor (not shown but located at the pharmacist) which comprises a variation or a modulation of the electrical power signal to be produced in the inductor (not shown) which comprises a variation or a modulation of the electrical power signal according to the control data. After such control data is sent, the circuitry then transfers electrical power to the inductor 60 which is substantially un-altered or unmodulated. That is, the electrical power signal from the power source is initially varied according to the control data received from the main controller. In this manner, control data may be transmitted from the main controller to the microprocessor 32 without the need for a physical connection therebetween or some sort of additional communication apparatus such as the RF transceiver 34.

Electrical power is typically transferred to the battery 48 in the form of pulses, but the same electrical power signal is modified or varied according to control or feedback data which is desired to be sent to the microprocessor 32 from the main controller.

By periodically activating and deactivating an electronic device within the circuit 50, the programmed microprocessor 32 causes a variation in the flux between the inductors including the inductor 60. This flux occurs and/or exists because of the aforementioned transfer of electrical power between the inductors. This variation in the flux may be used to send feedback data from the microprocessor 32 to the main controller. This feedback data is transmitted to the main controller by the selective activation and deactivation of an electronic device within the circuit 50 by the microprocessor 32. In this manner, feedback data such as data which represents the number of dispensed dosage forms may be transferred from the microprocessor 32 to the circuit 50 and then to the main controller, without the need for physical connection between the microprocessor 32 and the main controller.

FIG. 5 illustrates in block diagram form the major electrical and electronic components of at least one embodiment of the assembly 10. The "brains" of the assembly 10 is the microprocessor 32 which composes and sends IR transmit data packets to the IR transmitter 52 and composes, sends and receives RF data packets via the RF transceiver 34. The microprocessor 32 is also coupled to a detector or sensor (such as a proximity sensor (not shown)) to monitor the number of the dosage forms. The microprocessor 32 is also preferably coupled to switch(es) (such as monitor switches or motion switches) and/or electrical signals from drive circuitry of the various electromechanical parts of the assembly 10, the RF transceiver 34 and the IR transmitter 52. The microprocessor 32 may also display messages on an LED or LCD display (not shown—video alert) of the assembly 10, and/or may provide an audio alert via a sound transducer (not shown) of the assembly 10.

Some advantages of at least one embodiment of the present invention include:

(1) Cost Savings—Will reduce costs for insurance companies paying over $100 billion per year for overdose-related claims. Will also limit litigations toward doctors, pharmacies, and pharmaceutical companies for substance abuse cases.

(2) Risk Management—Liabilities of doctors, pharmacies, and pharmaceutical companies will decrease, therefore giving them more comfort in successfully doing their jobs without fear of lawsuits, license revocation, or scrutiny due to patient abuse. This should also decrease their liability insurance cost.

(3) Public Safety—This invention promotes a safer, healthier population by reducing the illnesses, deaths, and psychological problems associated with drug abuse.

(4) Senior Citizen Comfort—Many senior citizens can provide for themselves without assistance from others. In many cases, seniors are fully capable of unassisted living, but have a high risk of accidental overdose by forgetting if they have taken their medication or not.

(5) Prescription Drug Black Market Impact—Without immediate access to multiple pills at a time, prescription drug trafficking should decrease.

(6) Hospitals—By lowering the number of overdose patients to the emergency room, doctors and nurses can put more focus on trauma, or ill patients.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A portable, time-release, dosage form dispensing assembly comprising:

a hopper for holding a supply of like, loose and randomly oriented dosage forms, the hopper including a bottom portion having an opening sized and shaped for receiving one of the dosage forms;

an electromechanical apparatus that dispenses the dosage forms from the hopper through the opening, the apparatus being adapted to dispense the dosage forms to a dispensing area one dosage form at a time;

a programmable controller for generating a set of control signals to control the apparatus to dispense a preselected number of dosage forms at a preselected time of day or time interval; and a communication apparatus for communicating a first set of data to the controller to program the controller, the first set of data representing the preselected number and the preselected time of day or time interval wherein the electromechanical apparatus includes an electric motor having a rotary output shaft, gearing in driving engagement with the shaft, and a wheel in driving engagement with the gearing and supported for rotary movement immediately adjacent the opening, the wheel having an aperture extending completely therethrough wherein a single dosage form is dispensed to the dispensing area when the aperture and the opening are substantially aligned.

2. The assembly as claimed in claim 1, wherein the communication apparatus is a two-way communication apparatus for wirelessly communicating the first set of data to the controller and a second set of data from the controller, the second set of data representing the number of dispensed dosage forms.

3. The assembly as claimed in claim 2, wherein the communication apparatus includes a transceiver.

4. The assembly as claimed in claim 3, wherein the transceiver is an RF transceiver.

5. The assembly as claimed in claim 1, further comprising an electromechanical vibrator to vibrate the hopper so that dosage forms are advanced towards the opening.

6. The assembly as claimed in claim 5, further comprising a rechargeable battery and circuitry coupled to the battery to wirelessly receive an electrical power signal to recharge the battery, the battery providing electrical energy to the controller, the electromechanical apparatus, the communication apparatus and the vibrator.

7. The assembly as claimed in claim 1, further comprising a rechargeable battery and circuitry coupled to the battery to wirelessly receive an electrical power signal to recharge the battery, the battery providing electrical energy to the controller, the electromechanical apparatus and the communication apparatus.

8. The assembly as claimed in claim 7, wherein the circuitry includes an electrical coil to inductively receive the electrical power signal.

9. The assembly as claimed in claim 8, wherein the electrical coil also receives the first set of data.

10. The assembly as claimed in claim 1, wherein the communication apparatus includes an IR transmitter to wirelessly communicate a second set of data from the controller, the second set of data representing the number of dispensed dosage forms.

11. The assembly as claimed in claim 1, wherein the programmable controller includes a microprocessor.

12. The assembly as claimed in claim 1, further comprising a housing including top and bottom parts and a locking mechanism to prevent removal of the top part from the bottom part and prevent access to the hopper by a user of the assembly.

13. The assembly as claimed in claim 12, further comprising a door having open and closed positions, the door being movably connected to the bottom part to permit access to the dispensed dosage forms in the open position.

14. The assembly as claimed in claim 1, wherein the size of the aperture is adjustable to receive dosage forms having different sizes.

15. A portable, time-release, dosage form dispensing assembly comprising:

a hopper for holding a supply of like, loose and randomly oriented dosage forms, the hopper including a bottom portion having an opening sized and shaped for receiving one of the dosage forms;

an electromechanical apparatus that dispenses the dosage forms from the hopper through the opening, the apparatus being adapted to dispense the dosage forms to a dispensing area one dosage form at a time the electromechanical apparatus including an electric motor, gearing coupled to the motor and a wheel engaged with the gearing, the wheel having an aperture configured to be aligned with the opening to dispense the dosage forms;

an electromechanical vibrator to vibrate the hopper so that dosage forms are advanced towards the opening;

a programmable controller for generating a set of control signals to control the apparatus to dispense a preselected number of dosage forms at a preselected time of day or time interval;

a two-way communication apparatus for communicating a first set of data to the controller to program the controller, the first set of data representing the preselected number and the preselected time of day or time interval and for wirelessly communicating a second set of data from the controller, the second set of data representing the number of dispensed dosage forms; and a rechargeable battery and circuitry coupled to the battery to receive an electrical power signal to recharge the battery, the battery providing electrical energy to the controller, the electromechanical apparatus, the communication apparatus and the vibrator.

16. The assembly as claimed in claim 15, wherein the circuitry includes an electrical coil to inductively receive the electrical power signal.

17. A portable, time-release, dosage form dispensing assembly comprising:

a hopper for holding a supply of like, loose and randomly oriented dosage forms, the hopper including a bottom portion having an opening sized and shaped for receiving one of the dosage forms;

an electromechanical apparatus that dispenses the dosage forms from the hopper through the opening, the apparatus being adapted to dispense the dosage forms to a dispensing area one dosage form at a time, wherein the electromechanical apparatus includes an electric motor having a rotary output shaft, gearing in driving engagement with the shaft, and a wheel in driving engagement with the gearing and supported for rotary movement immediately adjacent the opening, the wheel having an aperture extending completely therethrough wherein a single dosage form is dispensed to the dispensing area when the aperture and the opening are substantially aligned;

a programmable controller for generating a set of control signals to control the apparatus to dispense a preselected number of dosage forms at a preselected time of day or time interval; and a communication apparatus for wirelessly communicating a first set of data to the controller to program the controller, the first set of data representing the preselected number and the preselected time of day or time interval.

18. The assembly as claimed in claim 17, further comprising a housing including top and bottom parts and a locking mechanism to prevent removal of the top part from the bottom part and prevent access to the hopper by a user of the assembly.

19. The assembly as claimed in claim 18, further comprising a door having open and closed positions, the door being movably connected to the bottom part to permit access to the dispensed dosage forms in the open position.

* * * * *